United States Patent [19]

Liska

[11] 4,238,073

[45] Dec. 9, 1980

[54] PAINT SPRAY APPARATUS HAVING PRESSURE ACTUATED CONTROL

[76] Inventor: Miroslav Liska, 1242 Holt St., Los Angeles, Calif. 90035

[21] Appl. No.: 24,170

[22] Filed: Mar. 26, 1979

[51] Int. Cl.[3] ..... B05B 9/00

[52] U.S. Cl. ..... 239/127; 417/34

[58] Field of Search ..... 417/34, 26; 222/68, 222/318; 239/124, 127

[56] References Cited

U.S. PATENT DOCUMENTS

| | | | |
|---|---|---|---|
| 3,147,767 | 9/1964 | Goss | 417/316 X |
| 3,501,899 | 3/1970 | Allen | 417/4 S X |
| 3,876,336 | 4/1975 | Nash | 417/38 |
| 4,035,107 | 7/1977 | Kesten et al. | 417/310 |
| 4,047,665 | 9/1977 | Movnihan | 239/124 |

*Primary Examiner*—Christopher K. Moore

*Attorney, Agent, or Firm*—Huebner & Worrel

[57] ABSTRACT

A paint spray apparatus having an airless pump driven by an internal combustion engine, the pump being adapted to provide a continuous paint flow to a spray nozzle or through a relief valve when the nozzle is closed. There is a pressure actuated throttle valve connected to the pump outlet and connected to operate an engine governor or throttle. The throttle valve is set to reduce the engine speed to idling when the spray nozzle is closed, and to reduce the fluid flow through a relief valve which is opened when the nozzle is closed. The throttle valve includes two aligned chambers having an elongated piston extending into both chambers. The pump outlet is connected to one of the chambers in which the outlet pressure acts on the piston to cause it to slide in the chambers and to move the other end of the piston into contact with a governor arm or throttle to effect the slowing of the engine and of the pump to reduce the flow of the fluid out of the pump. The piston is biased in normal operating position out of contact with the throttle by means of two aligned springs in the other of the two chambers.

11 Claims, 4 Drawing Figures

FIG. 1.
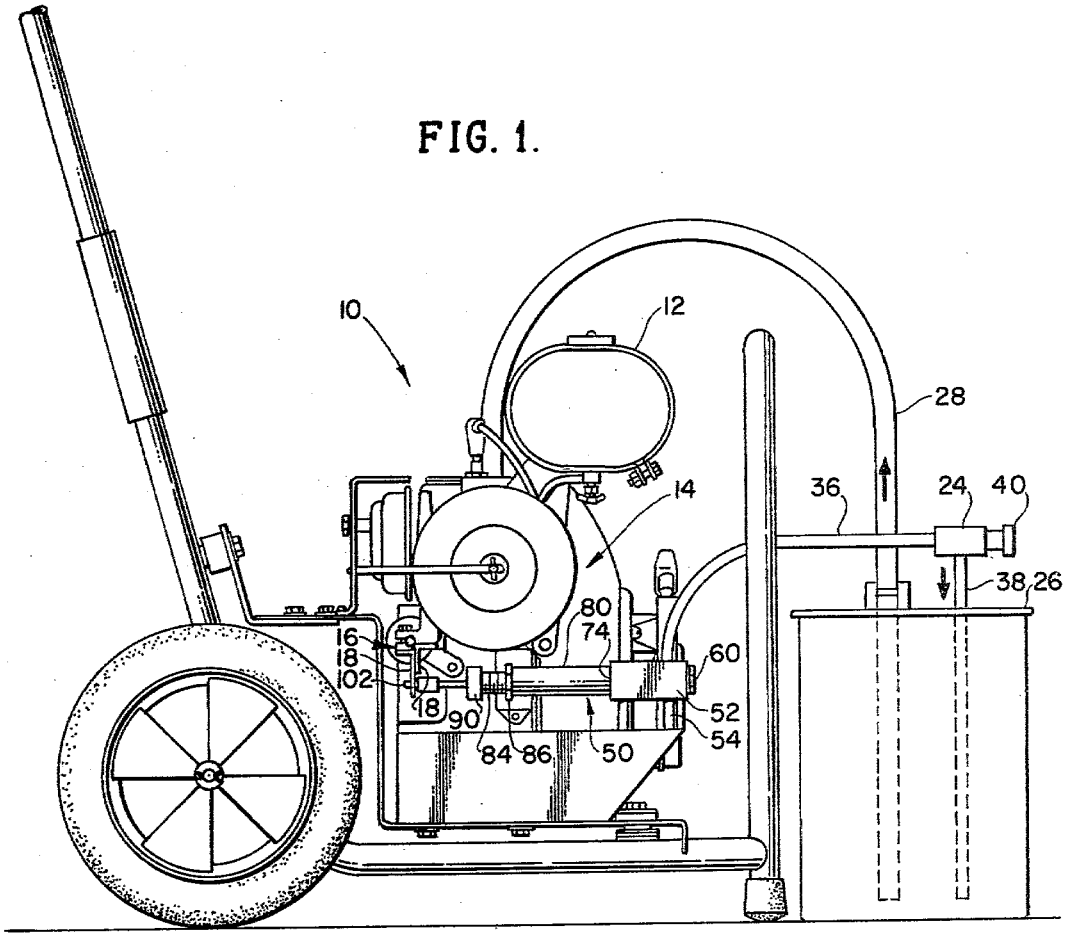
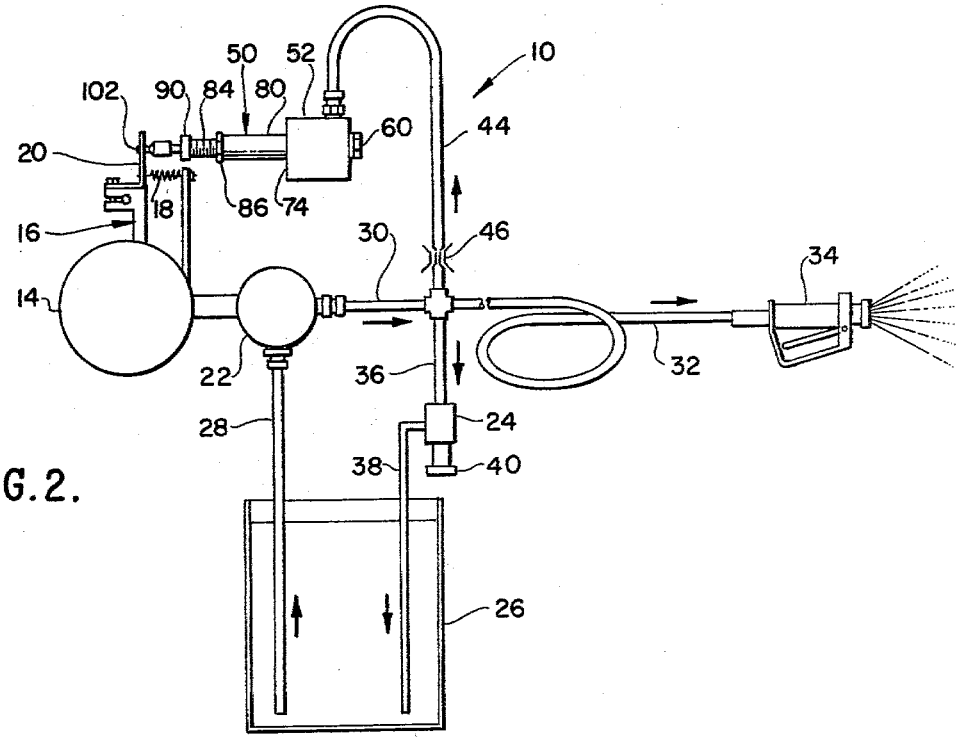
FIG. 2.

PAINT SPRAY APPARATUS HAVING PRESSURE ACTUATED CONTROL

BACKGROUND OF THE INVENTION

The type of airless pump used in the present invention is shown and described in U.S. Pat. No. 4,035,107. The said patent also includes a relief valve of the type used in the present invention and is shown in FIG. 5 of the patent and described as unloading valve 22.

In a paint spraying operation, the painter usually starts spraying the top of a wall, for example, and continues spraying downwardly until the entire vertical portion of the wall is painted. At this time the painter closes the spray nozzle and directs the nozzle to the upper part of the wall adjacent the column that has been just painted. The nozzle is then opened. These steps are repeated throughout the entire painting job.

One of the requirements in this type of operation is the need for immediate full flow of paint through the nozzle when it is opened. If the pressure is reduced significantly or the flow is decreased each time the nozzle is repeatedly opened, time is lost and the painting is not uniform at the start and fishtailing occurs.

In the prior art, gasoline engines for driving airless paint spray pumps were speed adjusted before starting to spray. The speed adjustment was determined according to the requirement of the size of the spray nozzle to be used. The engine rpm may be as high as 4000 and the pressure may be 2500 psi. During the painting operation, when the nozzle was shut off, paint was relieved through a relatively small relief valve. While the paint was allowed to continuously flow through the relief valve at the set high rate, this heated the paint excessively. The heat caused a drying effect in the paint relieved to the paint source.

Another problem that occured in the above high speed pre-setting adjustment was that when the nozzle size had to be changed, the speed of the engine had to be readjusted. This required the painter to come down from a scaffold or roof, etc. to adjust the engine speed for the different size nozzle. The same kind of adjustment problem occurred when two nozzles were operated from one pump and one of the nozzles was shut off.

The basic problems were that there was no convenient way to slow the engine when the nozzle was frequently closed and then speeded up when the nozzle was reopened.

SUMMARY OF THE INVENTION

The present invention is an apparatus for spraying abrasive liquids, such as paint, in which a pressure operated throttle valve is used to control the output of a pump. The throttle valve is connected to the pump outlet and is actuated by the pump outlet pressure to slow the engine to idling when the spray nozzle is closed and to speed up the engine as soon as the nozzle is opened after each closure thereof. When the engine is so caused to idle at between 1200 and 1400 rpm, there is a continual flow but the amount is greatly reduced.

With the use of the throttle valve when the nozzle is opened each time to resume painting, there is a pressure drop of only approximately 200 psi below the normal painting pressure, and this is not sufficient to be noticeable in the painting operation. This provides an important advantage during the painting operation where the nozzle is closed and opened very frequently as the painter moves it from a starting point of the painting to the terminating point, which is typically the height of a wall or the extent of the painter's reach relative to the surface he is painting.

The hose between the pump and the spray nozzle is an accumulator of paint under pressure so that when the nozzle is opened and the pressure drops 200 psi, the engine speed is immediately increased sufficiently to bring the pressure up to normal.

In the apparatus the relief valve is set at a higher pressure than the pressure required to actuate the throttle valve to slow down the engine. Thus, when the spray nozzle is closed the throttle valve is pressure actuated to slow down the engine to idling, and at this point the pressure in the hose is increased so as to open the relief valve which returns the fluid being pumped at idling speed to the source. One of the advantages of this arrangement is that when the engine is slowed to idling and the liquid flow is substantially reduced, the exessive heating of the paint is eliminated.

Paint is a very abrasive liquid and decreasing its flow through the relief valve, reduces the wear thereon. To have a continuous operation the engine must continue to run at a sufficient rate to provide a continuous flow, but the reduction in flow through the relief valve is very important in that it prevents frequent replacement of relief valve parts.

Another substantial advantage of the invention is that no manual adjustment of the engine speed is required during a painting operation. That is, there is no adjustment required when the spray nozzle is shut off or opened, or when different size orifices are inserted into the nozzle. This system also permits the use of two spray nozzles at the same time, for example, or use of only one of the two without any manual adjustment to the engine.

Accordingly, it is an object of the invention to provide an improved abrasive liquid spraying apparatus having an improved pressure actuated control device or throttle valve.

It is another object of the invention to provide a spraying apparatus, as described above, which is very uncomplicated in structure and operation.

It is still another object of the invention to provide an improved engine speed control in the form of a throttle valve having a rod shaped piston and a long small diameter spring arrangement to hold the piston in an inoperable position when the pump is running at normal speed. Such a spring arrangement has a low compression rate per linear inch and is sensitive to the smallest pressure change on the piston. In addition, the spring arrangement of small diameter and substantial length reduces the size of the structure and its weight.

It is a further object of the invention to provide an abrasive liquid spraying apparatus and throttle valve, as described in the preceding paragraphs, in which the throttle rod piston extends into two chambers forming the control device housing. One of the chambers is connected to the pump outlet and the other chamber contains the piston rod which acts on the engine governor or throttle, and in which elongated narrow springs are positioned around the rod. The latter chamber is formed of two cylindrical parts, one being telescoped into the other and threadedly engaged so that rotation of one part in the other acts to adjust the springs to hold the piston in its position for normal painting when it does not act to slow the engine.

Further objects and advantages of the invention may be brought out in the following part of the specification wherein small details have been described for the competence of disclosure, without intending to limit the scope of the invention which is set forth in the appended claims.

BRIEF DESCRIPTION OF THE DRAWINGS

Referring to the accompanying drawings, which are for illustrative purposes:

FIG. 1 is a side elevational view of a paint spraying apparatus having a throttle valve according to the invention;

FIG. 2 is a schematic view of the apparatus illustrating the directions of the paint flow therein;

DESCRIPTION OF THE PREFERRED EMBODIMENT

Figure 3:
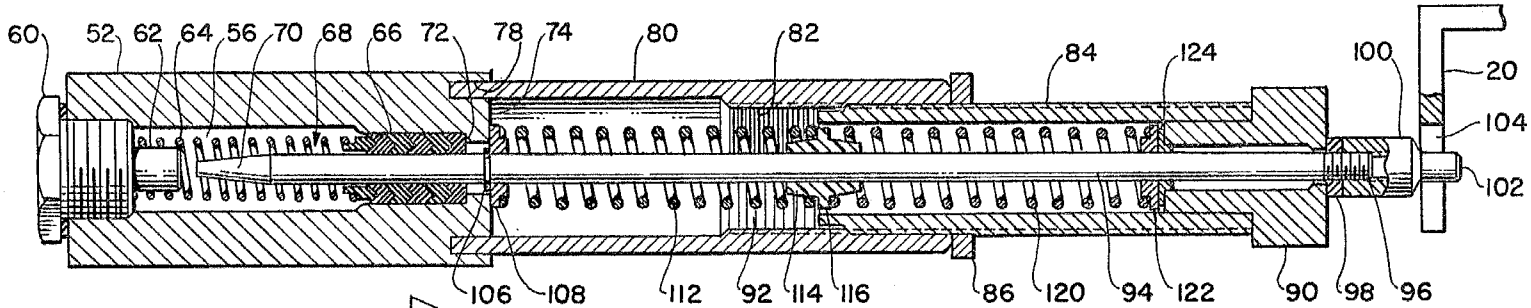
FIG. 3 is an enlarged cross-sectional view of the throttle valve.

Referring again to the drawings, there is shown in FIGS. 1 and 2 a paint spraying apparatus, generally designated as 10. The apparatus includes a gasoline tank 12 for containing fuel for the gasoline engine 14, having a governor or throttle, generally designated as 16.

The engine speed regulating means 16 is typically set for normal painting operations so as to run the engine at a constant speed of about 4000 rpm to produce about 2500 psi of paint pressure from the pump outlet. There is an adjustable tension spring 18, FIG. 2, mounted on the engine 14 so as to hold a governor or throttle arm 20 at a set, normal operating speed.

The engine 14 is connected by pulleys and a belt, not shown, to operate a constant flow airless pump 22, as shown in U.S. Pat. No. 4,035,107. The pump has a relief valve 24 of the same type as that shown in the aforesaid patent. The pump takes a suction from a paint container 26 through an inlet tube 28. The pump has an outlet 30 which is connected to a hose 32 having a paint nozzle 34 on its end. When the nozzle is closed and the pump is running the hose 32 acts as an accumulator.

Connected to the outlet 30 by means of a tube 36 is the relief valve 24 which discharges when open through a tube 38 into the paint container 26. The relief valve has a spring held ball valve, the spring being adjusted by a threadedly engaged telescoping control knob 40. When the knob 40 is turned in one direction the opening pressure is increased and when turned in the other direction is decreased.

Also connected to the outlet is a tube 44 having a flow restriction 46. The tube 44 is connected to a throttle valve, generally designated as 50. Thus, there is a four-way connection to the pump outlet, the spray nozzle, the relief valve and the throttle valve.

The throttle valve 50 is formed of a block 52 having legs 54 which are secured to a mounting, as shown in FIG. 1. Within the block 52 is a pressure chamber 56, FIG. 3, to which is connected the tube 44 in a threaded opening 58, FIG. 4.

The chamber 56 is sealed at one end by threaded plug 60 having a small diameter cylindrical tip 62 at its inner end. Fitted on the tip 62 is a coil spring 64 which at one end engages the inner surface of the plug 60, and at its other end the spring engages herring bone packing 66 which forms a seal around a throttle valve piston, generally designated as 68, formed as a rod with a truncated conical end 70. The spring 64 holds the packing 66 in a sealing arrangement around the piston and in abutment with an annular shoulder 72 adjacent end 74 of the block 52. The block end 74 has an annular groove 78 in which one end of a cylindrical chamber part 80 is press fit. The other end of the cylinder 80 has internal threads 82 into which an externally threaded cylindrical member 84 is telescoped and threadedly engaged. A locking nut 86 holds the member 84 in the member 80 at a predetermined position. Inserted into the outer end of the tubular member 84 is a plug 90.

Figure 4:
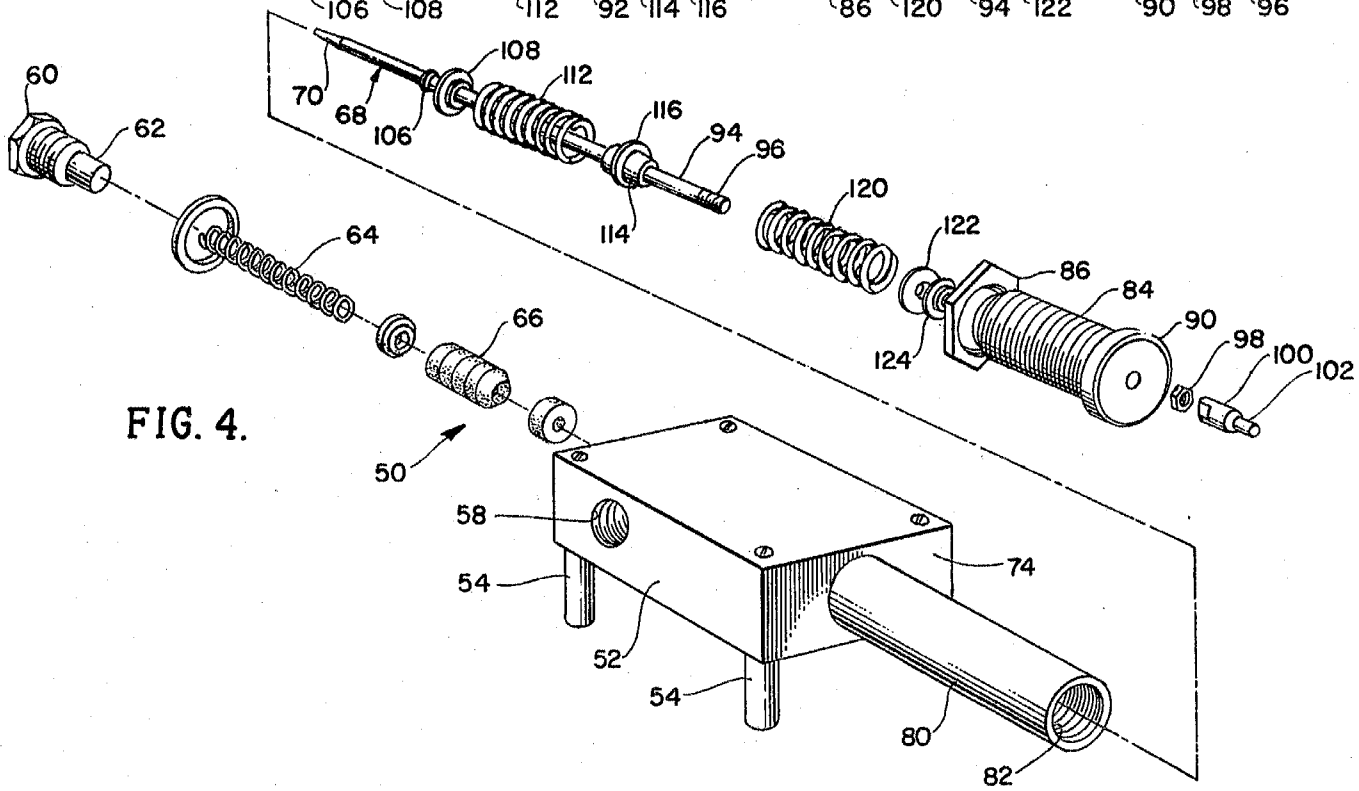
FIG. 4 is an exploded view of the throttle valve.

The cylindrical members 80 and 84 form a second chamber 92, FIG. 3, into which a rod portion 94 of the piston 68 extends. There are threads 96 at the end of portion 94 extending outwardly of the plug 90, and the piston is secured in place by a locking nut 98. Also threadedly engaged on the threads 96 is a governor or throttle actuating member 100 having a small diameter 102 at its end fitted within a bifurcated portion 104 of the speed regulating throttle or governor arm 20.

Secured to the piston rod portion 94 within the chamber 92 is a snap ring 106, and slidably engaged on the rod portion 94 is a spring plate 108 normally held in abutment against the outer surface of end 74 of the block 52 by means of a coil spring 112 surrounding the piston portion 94. Pressure on the piston is exerted on the springs through ring 106.

Slidably engaged on the piston rod portion 94 is a spring coupler 114 having an annular flange 116 on which spring 112 acts. The other side of the flange 116 is in abutment with a second coil spring 120, and the other end of the spring 120 abuts a spring plate 122 in abutment with a teflon washer 124 fitted within the inner end of the plug 90 and around the rod portion 94.

The springs 112 and 120 effectively act as one long small diameter spring having a low compression rate per linear inch so as to be sensitive to slight pressure changes. The spring compression rate is about 22.3 pounds per linear inch, for example. The springs are divided into two parts abutting the coupler flange 116, because a continuous long and narrow spring would tend to buckle. By using two springs instead of one, the small diameter of the spring is achieved and permits a small diameter chamber 92 surrounded by relatively lightweight tubular members. The spring setting is made by the rotation of the member 84 in the member 80 and they are locked in place by the nut 86.

During normal operation when the engine is running at a speed of approximately 4000 rpm and the pump outlet pressure is about 2500 psi, the governor or throttle arm 20 is adjusted to be out of contact with the large diameter part 100 at the end of the rod 94. The arm 20 is held in place by the tension spring 18. It is only when the pressure through the tube 44 increases so as to be greater than that of the springs 112 and 120 that the piston is moved to the right in FIG. 3 against the arm 20 to slow the throttle or governor setting.

The springs 112 and 120 are set to permit the engine to operate at the maximum rpm for a particular operation and the end 100 of the rod is positioned so that when the pressure in the tube 44 is increased by the closing of the nozzle, the piston will be moved to the right in FIG. 3 to pivot the governor arm 120 so as to reduce the engine speed to idling to between 1200 and 1400 rpm. When this occurs, the pump output is substantially reduced, but the pressure is increased so as to open the relief valve which is set to open at a slightly higher pressure than the piston 68. Thus, while the nozzle is closed, there is a small flow through the relief valve into the container 26.

It is necessary that the engine operate continuously during a painting job because of the way the nozzle is repeatedly opened and closed and so that an instant high flow and pressure is developed when the nozzle is opened. The small rate of flow through the relief valve is very significant because it substantially reduces abrasion of the relief valve parts in contrast to what the abrasion would be if the flow were at a higher rate, which would occur if the engine were not idling.

For any particular pumping operation, the pump is first primed with the engine running at the high operating speed and with the relief valve open so as to not apply a pressure to the piston 68 through the line 44. Then to increase the pressure in the system, the relief valve is adjusted by turning the knob 40 to increase the pressure at which it will open, and as it is closed the pressure will be applied to the piston to reduce the engine speed to idling. In this way the relief valve is set at the proper pressure and the bias of the springs 112 and 120 is set to be overcome by the pressure in the pump outlet so as to idle the engine at the proper time when the spray nozzle is closed.

Thus, it may be seen that for any particular spraying operation the engine is set to operate at its proper or near maximum speed, and as soon as the spraying nozzle is closed, as it frequently is, the engine will immediately idle, causing a substantially reduced flow in the pump outlet but at a slightly greater pressure to open the relief valve and return the paint being pumped during idling to the paint source. Because of this simple arrangement, as soon as the spray nozzle is again opened, the relief valve closes and the piston 68 moves left in FIG. 3 so as to allow the spring 18 to return the governor arm 20 to its normal high speed position. This results in instant high speed and high pressure flow through the hose, which during the change in engine speeds acts as an accumulator so that the pressure loss on the opening of the nozzle is as low as 200 psi which is insignificant to the painter.

When during a painting operation, a spray orifice size is changed, the piston will properly self-adjust so that manual adjustments are not necessary. Similarly, if one of two nozzles are closed the piston will automatically adjust the engine speed to provide proper pressure and paint flow.

The invention and its attendant advantages will be understood from the foregoing description and it will be apparent that various changes may be made in the form, construction and arrangements of the parts of the invention without departing from the spirit and scope thereof or sacrificing its material advantages, the arrangements hereinbefore described being merely by way of example. I do not wish to be restricted to the specific forms shown or uses mentioned except as defined in the accompanying claims, wherein various portions have been separated for clarity of reading and not for emphasis.

I claim:

1. In an abrasive liquid spraying apparatus, an airless pump having an inlet and an outlet, an internal combustion engine for driving said pump, said engine having a speed regulating means, said inlet being connected to a liquid source and said outlet being connected to a liquid spray nozzle by a hose, the improvement comprising:

a liquid pressure actuated throttle valve connected to said pump outlet and positioned to operate said speed regulating means, said throttle valve having means to operate said regulating means to reduce the engine speed from operating speed to idling when the spray nozzle is closed.

2. The invention according to claim 1 in which:

said means to operate is actuated by a predetermined pressure in said pump outlet to idle the engine when the nozzle is closed, a relief valve connected to said pump outlet being set to open at a higher pump outlet pressure than said predetermined pressure in the outlet, said relief valve being set to open at said higher pressure when said spray nozzle is closed and said engine is idling, said outlet pressure being increased to open the relief valve when the spray nozzle is closed and the engine is idling, said relief valve being connected to discharge to said liquid source, said flow through said relief valve being at a substantially reduced rate with respect to the rate through the spray nozzle when the engine is running at operating speed, the reduced flow through the relief valve being adapted to reduce abrasion on the relief valve parts.

3. The invention according to claim 2 in which:

said relief valve being set so that the discharge pressure of said reduced liquid flow therethrough is slightly higher than that of the pump outlet pressure when the nozzle is open and the engine is running at operating speed.

4. The invention according to claim 2 in which said means to operate said throttle valve includes:

two aligned first and second chambers, an elongated piston extending in said first and second chambers and having one end extending outwardly of said second chamber, means on said one end positioned to operate said speed regulating means, the other end of said piston being in said first chamber and being exposed to liquid pressure from said outlet, said piston being supported in said chambers to slide therein and outwardly of said second chamber to move said speed regulating means in an engine slowing direction to idle the engine when the pump outlet pressure equals said predetermined pressure, sealing means around said piston to seal said first chamber from said second chamber, spring means in said second chamber to normally bias said piston to a position free of said speed regulating means, said piston being adpated to overcome the force of said spring means when the liquid pressure in said outlet equals said predetermined pressure.

5. The invention according to claim 4 in which:

said piston is in the form of a rod in both of said chambers.

6. The invention according to claim 5 in which:

said spring means in said second chamber includes first and second aligned coil compression springs surrounding said rod, one end of the first spring abutting a plate surrounding the rod adjacent the first chamber at one end of the second chamber, means secured to said piston associated with said plate to compress said springs when outlet pressure in excess of the force of said springs is applied to said piston in the first chamber, a spring coupler slidably engaged on said rod and spacing said springs, said first spring having its other end abutting said coupler on one side thereof and said second spring having one end abutting said coupler on the other side thereof, the other end of said second spring effectively abutting the other end of said second chamber.

7. The invention according to claim 6 in which:

said second chamber includes two generally cylindrical parts forming inner and outer surfaces of the chamber, one of said second chamber parts being telescoped into the other, said one part having external threads engaged with internal threads in the other, said springs in said second chamber being pressure adjusted according to the rotation of said one part with the other on said threads.

8. The invention according to claim 7 in which:

a locking nut engages with said external threads on said one part and abuts the outer end of the other part to lock said parts in adjusted positions.

9. The invention according to claim 8 in which:

said means on said one end of said piston is a speed regulating means actuating device outwardly of said one part of said second chamber, said device being cylindrical and having a small diameter portion on its outer end.

10. The invention according to claim 6 in which:

said first and second springs are elongated and of relatively small diameter, having a rate of compression per linear inch of about 22 pounds.

11. The invention according to claim 1 in which:

said throttle valve being connected to said pump outlet and the speed regulating means so that variation of the engine speed is immediately effective to correspondingly vary the pump speed and pump outlet pressure.

* * * * *